United States Patent [19]

Kuchenbecker

[11] Patent Number: 4,574,956

[45] Date of Patent: Mar. 11, 1986

[54] FOOD CONTAINER AND COVER THEREFOR

[75] Inventor: Morris W. Kuchenbecker, Neenah, Wis.

[73] Assignee: James River Corporation of Virginia, Richmond, Va.

[21] Appl. No.: 577,146

[22] Filed: Feb. 6, 1984

[51] Int. Cl.[4] ..... B65D 3/26; B65D 5/70

[52] U.S. Cl. ..... 206/623; 206/627; 206/629; 206/633; 229/43

[58] Field of Search ..... 229/43; 206/620, 621, 206/623, 627, 628, 629, 633

[56] References Cited

U.S. PATENT DOCUMENTS

| | | | |
|---|---|---|---|
| 3,672,916 | 6/1972 | Virnig | 229/43 |
| 3,951,331 | 4/1976 | Smith et al. | 229/43 |
| 4,187,977 | 2/1980 | Boykin et al. | 229/43 |
| 4,264,031 | 4/1981 | Goebel | 229/43 |
| 4,369,892 | 1/1982 | Uhlig | 229/43 |

*Primary Examiner*—Joseph Man-Fu Moy

*Attorney, Agent, or Firm*—Gordon W. Hueschen

[57] ABSTRACT

There is disclosed a cover for a container for food, for example, popcorn. The container has a rim on which is sealed an expandable foil cover. A paperboard cover overlies this foil cover and is held in place by a flange on the rim which is bent over or crimped onto the pressboard. The cover has a removable central portion, e.g., formed by concentric half-cut sores, and an annular portion, which is crimped between the flange and the rim. The cover has a pull tab extending beyond this annular portion and the concentric half-cut scores curve up to the pull tab. The pull tab can be folded over on a press core and crimped under the flange. The annular portion comprises an inner and outer zone, the outer one of which comprises a plurality of tabs projecting from the inner zone. These tabs may have different shapes, for example, they are preferably arcuate so as to give the outer zone a scalloped appearance. A wire handle may be provided, having a circular portion which overlies the tabs and if fastened to the rim when the flange is crimped.

18 Claims, 11 Drawing Figures

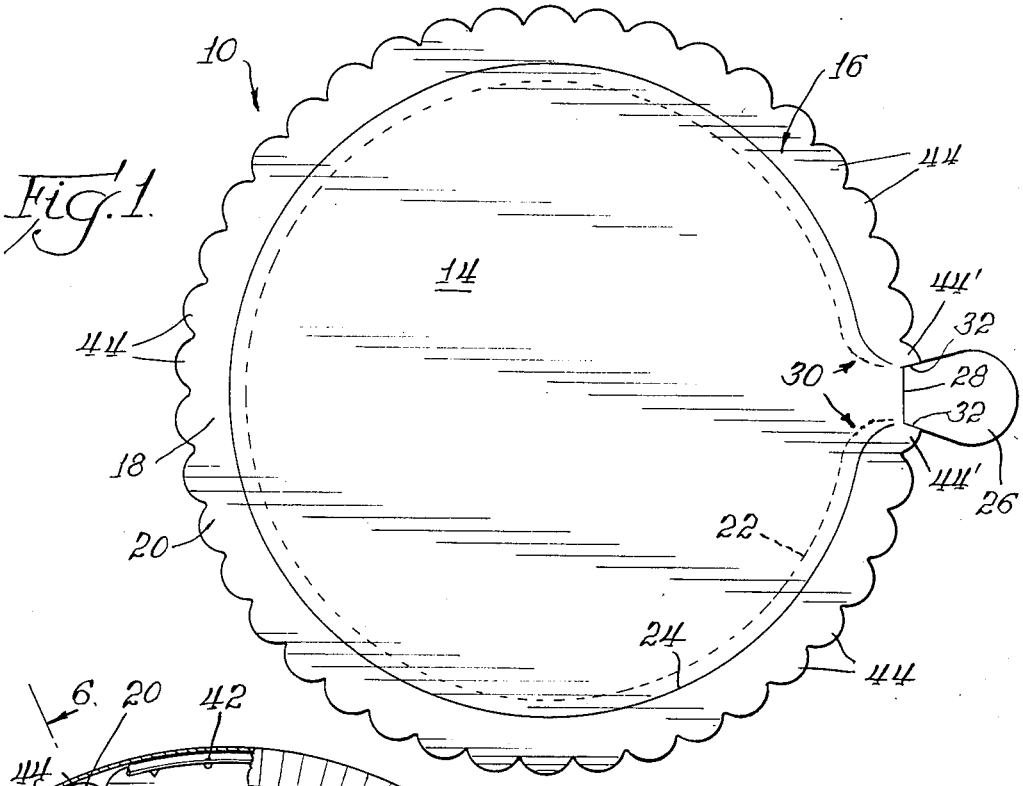
Fig. 1.
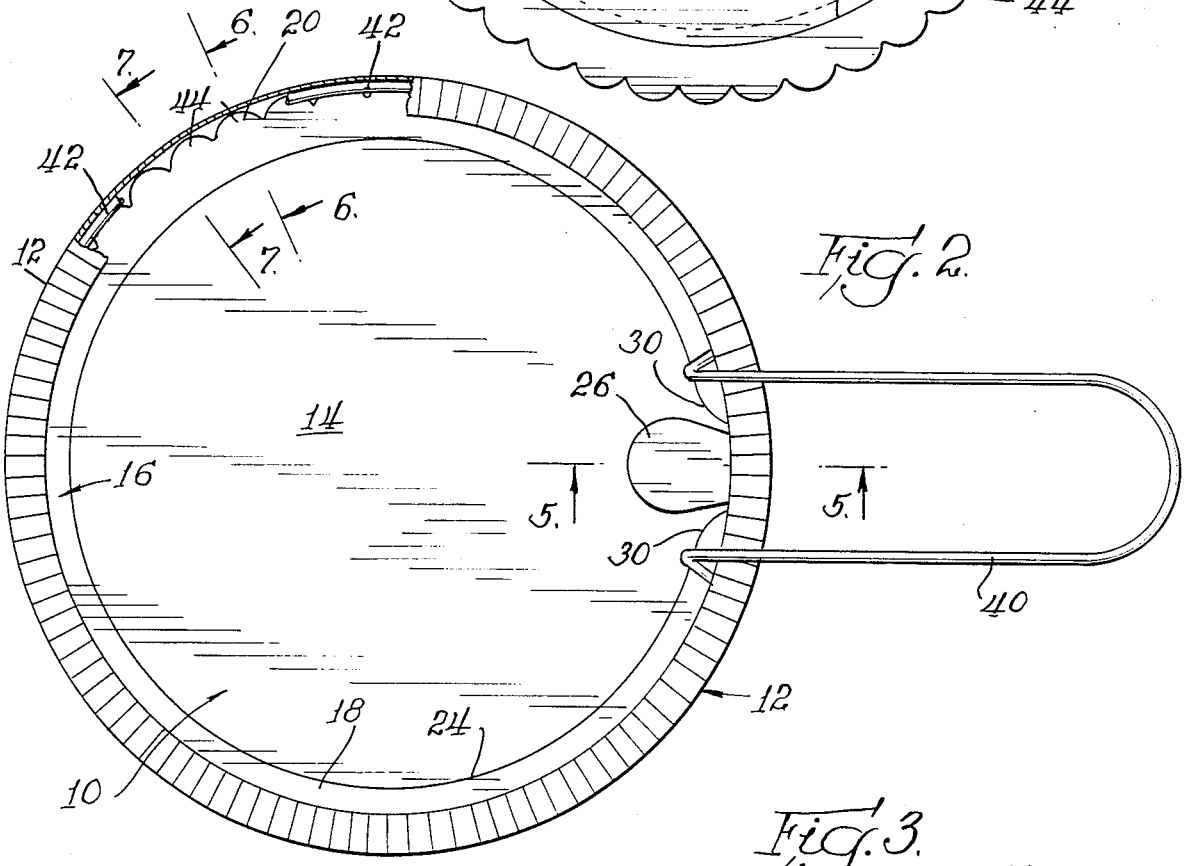
Fig. 2.
Fig. 3.
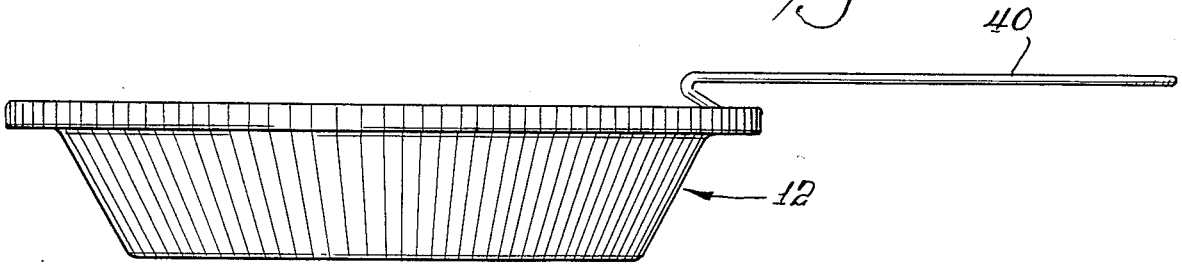

Fig. 5
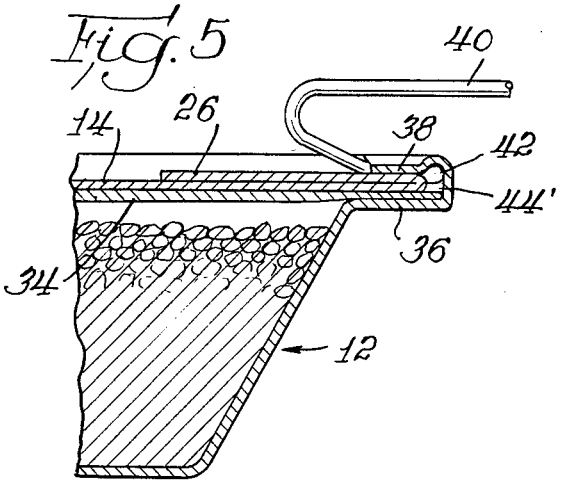
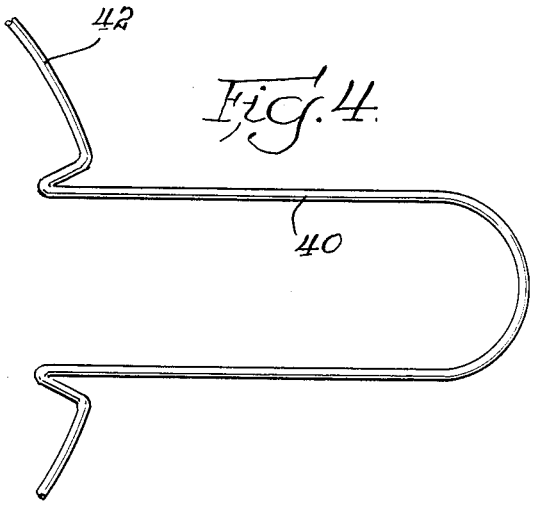
Fig. 4
Fig. 6
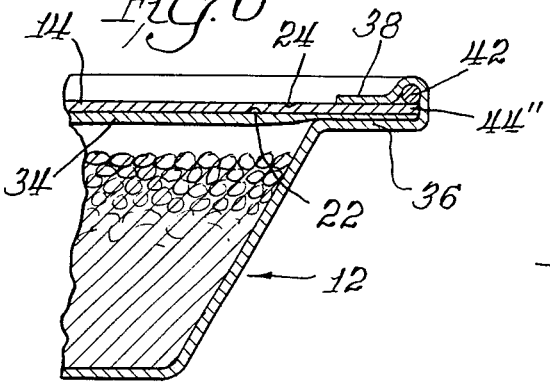
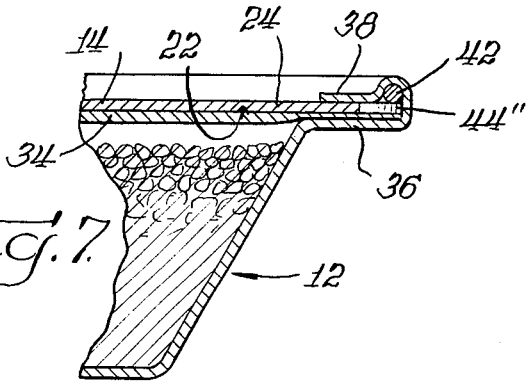
Fig. 7
Fig. 8
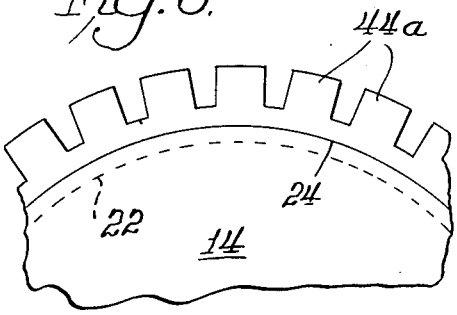
Fig. 9
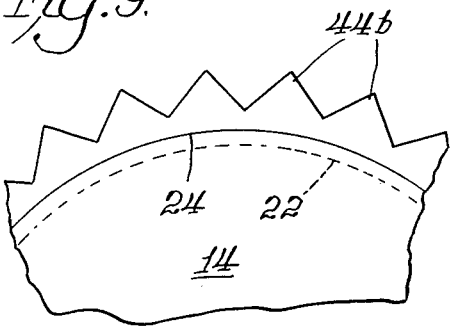
Fig. 10
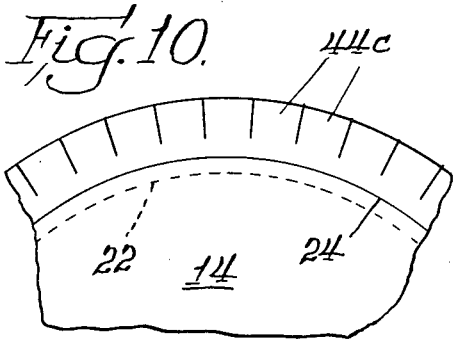
Fig. 11
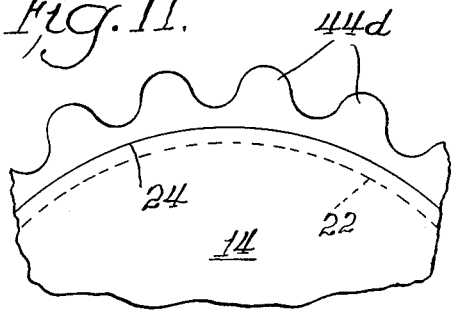

FOOD CONTAINER AND COVER THEREFOR

BACKGROUND OF THE INVENTION

1. Field of Invention

This invention relates to an improved cover for a food container, which cover can be easily and neatly torn off of the container as by means of half-cut score lines formed in the cover. More particularly, this invention relates to an improved container cover which will not prematurely rupture when the cover is secured to the container or roughly handled.

2. Prior Art

The packaging of foods in metal containers in which they must be heated preparatory to serving is a widespread practice. Among the foods thus packaged are raw corn kernels for making popcorn. The container includes a relatively heavy gauge aluminum foil pan and a relatively light gauge expansible aluminum foil cover sealed around its periphery to the pan. A protective paperboard cover overlays the expansible aluminum foil cover to protect the foil cover and to provide for graphics display on the top of the container.

According to U.S. Pat. No. 4,386,706, issued Jan. 7, 1983 to Kurtz, the paperboard cover can be removed from the container by means of half-cut score lines formed in the cover close to the periphery of the cover, and a tear tab formed in the cover with full-cut score lines. Removal is accomplished by lifting the tear tab and pulling upward, whereby the central portion of the cover is peeled off of the container with rupture of the cover occurring along the half-cut score lines. The peripheral margin of the cover is left attached to the container. The container also includes a wire handle which has a first portion which is secured to the periphery of the container coextensive with the periphery of the cover, and which has a second portion extending outwardly of the container to provide means for manually grasping the handle. The heavy gauge aluminum foil pan and the light gauge aluminum foil cover are sealed to each other about their coextensive edges, with the sealed edges providing a crimping skirt which is folded over the margin of the light gauge aluminum foil cover to overlie the periphery of the paperboard cover and the first portion of the wire handle. The crimping skirt is then crimped down onto the margin of the light gauge aluminum foil cover to secure the paperboard cover and the wire handle to the container.

U.S. Pat. Nos. 4,194,680, issued Mar. 25, 1980 to Scott et al; 4,194,681, issued Mar. 25, 1980 to Scott et al; 4,211,360, issued July 8, 1980 to Scott et al; U.S. Pat. No. Des. 258,350, issued Feb. 24, 1981 to Scott et al; U.S. Pat. No. Des. 259,103, issued May 5, 1981 to Scott et al; and U.S. Pat. No. Des. 260,370, issued Aug. 25, 1981 to Peterson, all disclose the general type of paperboard container cover described above.

The difficulty with these constructions is that the pull tab in the cover is full-cut scored so that the cover is weakened in the portion with the result that the inner, expandable foil could be ruptured if a sharp corner were to press down in that area. While a fold-in tab is provided to overlie the cut portion, this gives only partial protection against such inadvertent rupture.

A problem has arisen in connection with the assembly of this type of container where the paperboard cover is formed in accordance with the teachings of the prior art. When the handle and paperboard cover are secured to the container by the crimping of the compound foil skirt, the crimping forces utilized have been sufficient to produce a premature rupturing or delamination of the half-cut score lines formed in the paperboard cover to facilitate removal thereof from the container. This premature delamination, or partial delamination, is naturally undesirable as it weakens the container structure and presents an unsightly appearance.

It has been proposed to remedy this difficulty (U.S. Pat. No. 4,386,706, supra) by means of a cover which is formed with the half-cut score opening zone, as in the prior art, and is also formed with an interrupted perforate line disposed between the periphery of the cover and the half-cut score opening zone. The interrupted perforated line extends completely around the cover to surround the half-cut score opening zone outwardly of the latter. The interrupted perforated line disposed between the crimped area and the half-cut score opening zone is intended to serve to sufficiently locally increase the flexibility of the paperboard cover so that the stress forces imparted to the paperboard cover during the crimping operation are not fully transmitted to the half-cut score opening zone whereby the latter does not delaminate. Neither does the interrupted perforated line rupture during the crimping operation. Thus, the paperboard cover is secured intact to the container without premature rupture occurring in the cover.

It has been found in practice, however, that notwithstanding said perforations, and especially when the cover has a full-cut scored pull tab, the problems encountered in crimping are only partially avoided and, moreover, little if any resistance to rupture or delamination, as a result of rough handling, is provided. In addition, the cut-through openings provided by the perforations in prior art lids, which cut-through openings are not necessary according to the present invention and which are accordingly obviated by the present invention, have the disadvantage of allowing air or other material to enter into the packaging through the cut-through openings of the perforations, which may have a drying out effect and which in any event allows direct exposure of the thin protective foil to the elements.

OBJECTS OF THE INVENTION

It is an object of the invention, therefore, to avoid the disadvantages of the prior art and to obtain such advantages as will appear as the description proceeds. It is a particular object of the invention to provide a food container of the class described with a completely intact paperboard cover in order to avoid inadvertent damage to the inner, expansible foil cover. It is a still further object of the invention to provide a food container of the class described in which inadvertent rupturing or delamination of the half-cut score opening zone as a result of the crimping of the container or as a result of the bending of the rim, or rough handling thereof, is materially minimized. Other objects of the invention will appear as the description proceeds.

SUMMARY OF THE INVENTION

The invention relates to a cover for a container having a rim with a peripheral flange adapted to be bent back upon said rim to hold said cover in place, comprising a sheet of paperboard having a removable central portion surrounded by an annular rim portion, said rim portion comprising an inner, annular, continuously intact zone and an outer, annular, discontinuously intact zone, which comprises a plurality of discrete tabs projecting from the periphery of said inner zone, each of which tabs can be flexed substantially independently of other tabs and of said inner zone whereby, when said rim portion is clamped between said rim and said peripheral flange, inadvertent disruption of the removable central portion in the manufacturing or handling of the container is minimized.

The invention also relates to an improvement in a container having a rim and a peripheral flange bent back upon said rim, a thin expandable foil inner cover sealed to said container rim, an overlying outer paperboard cover having a removable central portion and an annular rim portion overlying said container rim and clamped thereon by said peripheral flange, in which improvement said annular rim portion comprises an inner, annular, continuously intact zone and an outer, annular, discontinuously intact zone which comprises a plurality of discrete tabs projecting from the periphery of said inner zone, each of which tabs can be flexed substantially independently of other tabs and of said inner zone, whereby inadvertent disruption of the removable central portion in the manufacturing or handling of the container is minimized.

The invention may also comprise one or more of the following features in which said tabs are spaced from adjacent tabs a relatively small proportion of their width, advantageously juxtaposed; in which said tabs are essentially arcuate so that said outer zone has a scalloped appearance; in which said central portion is demarked by a pair of concentric half-cut scores, one of which is cut from the under surface and the other of which is cut from the outer surface; in which said central portion and said inner zone constitute a single imperforate sheet and in which said tabs are integral parts of said sheet; in which a pull tab is attached to said annular rim portion on a press score and in which said half-cut scores curve outwardly to the edges of the pull tab substantially at the ends of said press score, whereby said pull tab can be bent back onto the cover and held there when said flange is folded in to clamp the outer annular rim portion of the cover in place; and, in which said press score is located essentially at the interface of said outer and inner zones.

The container additionally may include a wire handle which projects radially from said container and has a circular portion clamped between the flange and the tabs of the outer annular zone and in which the press score is located inwardly of said wire, so that said folded back pull tab, while underlying said flange, does not underly said wire.

BRIEF DESCRIPTION OF THE DRAWINGS

In the drawings:

FIG. 1 is a plan view of the cover according to the invention;

FIG. 2 is a plan view of the container according to the invention;

FIG. 3 is a side elevation of FIG. 2;

FIG. 4 is a partial view of the wire handle;

FIG. 5 is a partial cross section of FIG. 2, taken on line 5—5;

FIG. 6 is a partial cross section of FIG. 2, taken on line 6—6;

FIG. 7 is a partial cross section of FIG. 2, taken on line 7—7;

FIG. 8 is a partial view of a modified form of FIG. 1;

FIG. 9 is a partial view of a modified form of FIG. 1;

FIG. 10 is a partial view of a modified form of FIG. 1; and

FIG. 11 is a partial view of a modified form of FIG. 1.

DESCRIPTION OF THE PREFERRED EMBODIMENTS

Referring now to FIGS. 1 and 2, at 10 there is shown a cover according to the invention and, at 12, a container according to the invention. The cover 10 comprises a removable central portion 14, surrounded by an annular rim portion 16, which comprises an inner, annular continuously intact zone 18 and an outer, annular, discontinuously intact zone 20.

The central portion 14 is separated from zone 18 by half-cut scores 22 and 24. The half-cut score 22 is cut from the underside of the cover, whereas the half-cut score 24 is cut from the upperside of the cover. By half-cut scores is meant a cut score which penetrates only part way into the board, leaving one surface cut and the opposite surface uncut. As this type of half-cut scoring is standard in this art, it need not be further described except it is sufficient to note that it provides for the ready removal of the central portion of the cover.

To facilitate this removal, the central portion is provided with a pull tab 26 connected thereto by a press score line 28. The half-cut score lines 22 and 24 curve outwardly, as shown at 30, to the edges of the pull tab 26, substantially at the ends of the press score 28. The pull tab 26 is separated from adjacent portions of the outer zone 20 by cuts 32 on each side extending outwardly from the ends of the press score 28. Pull tab 26 thus can be folded back on the central portion, as will be more particularly described hereinafter.

The cover 10 is seated in a filled container having an expandable foil sealing cover 34 with the outer rim 16 overlying a rim 36 of the container. A crimping flange 38 is then crimped over the paperboard cover 10. First, however, it is desired to seat a handle 40 therein. For this purpose the handle 40 is provided with a circular member 42 having a diameter essentially the same as the container out to the flange 38. This circular portion or member 42 is seated on the outer zone 20 of the cover adjacent the flange 38 before the crimping is effected.

As a result of the crimping there is obtained a structure shown in FIGS. 2 and 6, in which the flange 38 is bent to overlie the wire 42 which rests on the outer zone 20 of the cover which in turn rests on the expandable foil cover 34.

In accordance with the modification shown in FIG. 1, the outer zone 20 has a plurality of spaced tabs 44 which project outwardly from the inner zone 18 to a point where they underlie the wire 42, as shown in FIG. 2, and FIGS. 5, 6, and 7.

These tabs, as shown in FIG. 2, are arcuate or semicircular and are joined together by a very small curvature to give a half-wave scalloped edge. Thus, in accordance with a preferred embodiment of the invention, the radius of the tabs may be 0.25 inch, the height above the inner zone 18 about 0.19 inch. Adjacent tabs are connected by a small curve, about 0.03 inch in radius. The distance between the centers of these small curves then amounts to about 0.53 inch. The bottoms of these small curves coincide essentially with the outer edge of the inner zone 18. It is to be understood, however, that these dimensions, which are based on a cover having a radius of 3.688 inches to the outer edges of said tabs, are given by way of illustration only and that tabs of other sizes and shapes can be used as long as they project outwardly from the inner zone 18 and are independently flexible.

Suitable alternative shapes for the tabs 44 are shown in FIGS. 8, 9, and 10, and 11 at 44*a*, *b*, and *c*, respectively. If desired, the tabs 44 can be cut on a full-score scalloped pattern, as shown in FIG. 11, at 44*d*.

Advantageously, the cover is cut from a single sheet. The press score 28 of the pull tab 26 is located substantially at the interface of the inner zone 18 and the outer zone 20. This places the folded edge of the pull tab 26 inwardly of the wire 42, as shown in FIG. 5, wherein it is shown that the wire 42 rests on the tab 44' which is adjacent the pull tab 26.

From the section shown in FIG. 6, it will be observed that the wire is resting on the tab 44" whereas, in FIG. 7, it is over the space between the tab 44" and the adjacent tab.

The tab 26 is opposite the bight of the handle 40 so that the handle can be grasped in one hand and the tab in the other in order to pull the cover 14 away from the container and to expose the inner expansible foil cover 34. It can be located at other places around the periphery of the container, but greater ease of removal of the central portion 14 is obtained when it is located as shown. Advantageously, the tab 26 is located normal to the grain of the paper as this also facilitates removal of the central portion 14.

By providing the cover with a plurality of discrete tabs 44 projecting outwardly from the inner zone 18, increased flexibility is imparted to the outer zone 20. This results from the fact that each tab can flex independently of other tabs and also independently of the inner zone 18. The flexibility can be enhanced, if desired, by press scores at the interface between the tabs 44 and the inner zone 18.

The invention accordingly has advantages over the container and cover disclosed in U.S. Pat. No. 4,386,706, because the outer zone 8 thereof cannot flex independently of adjacent portions and, for that reason, cannot flex much relative to the inner zone, notwithstanding the perforations 22. The invention accordingly has advantages over the prior art in that it produced greater flexibility in the outer zone region of the cover, thus minimizing disruption or delamination as a result of stresses induced in the crimping process or as a result of rough handling of the container. In addition, the cut-through openings provided by the perforations in prior art lids, with their attendant disadvantages, are not necessary according to the present invention and are accordingly obviated by the present invention.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. A cover for a container having a rim with a peripheral flange adapted to be bent back upon said rim to hold said cover in place, comprising a sheet of paperboard having a removable central portion surrounded by an annular rim portion, said rim portion comprising an inner, annular, continuously intact zone and an outer, annular, discontinuously intact zone, which comprises a plurality of discrete tabs projecting from the periphery of said inner zone, each of which tabs can be fixed substantially independently of other tabs and of said inner zone, said rim portion being permanently clamped between said rim and said peripheral flange, whereby inadvertent disruption of the removable central portion in the manufacturing or handling of the container is minimized, said tabs are substantially juxtaposed; in which said central portion is demarked by a pair of concentric half-cut scores, one of which is cut from the under surface and the other of which is cut from the outer surface; in which said central portion and said inner zone constitute a single imperforate sheet and in which said tabs are integral parts of said sheet; in which a pull tab is attached to said annular rim portion on a press score and in which said half-cut scores curve outwardly to the edges of the pull tab substantially at the ends of said press score, whereby said pull tab can be bent back onto the cover and held there when said flange is folded in to clamp the outer annular rim portion of the cover in place; and in which said press score is located essentially at the interface of said outer and inner zones.

2. A cover of claim 1, in which said tabs are essentially block-shaped.

3. A cover of claim 2, in which said tabs are spaced from adjacent tabs a relatively small proportion of their width.

4. A cover of claim 2, in which said tabs are separated by radial cut-lines.

5. A cover of claim 1, in which said central portion is demarked by a pair of concentric half-cut scores, one of which is cut from the under surface and the other of which is cut from the outer surface.

6. A cover of claim 1, in which said central portion and said inner zone constitute a single imperforate sheet and in which said tabs are integral parts of said sheet.

7. A cover of claim 1, in which a pull tab is attached to said annular rim portion on a press score and in which said half-cut scores curve outwardly to the edges of the pull tab substantially at the ends of said press score, whereby said pull tab can be bent back onto the cover and held there when said flange is folded in to clamp the outer annular rim portion of the cover in place.

8. A cover of claim 7, in which said press score is located essentially at the interface of said outer and inner zones.

9. In a container having a rim and a peripheral flange bent back upon said rim, a thin expandable foil inner cover sealed to said bendable rim, an overlying outer paperboard cover having a removable central portion and an annular rim portion overlying said rim and permanently clamped thereon by said peripheral flange, the improvement in which said annular rim portion comprises an inner, annular, continuously intact zone and an outer, annular, discontinuously intact zone which comprises a plurality of discrete tabs projecting from the periphery of said inner zone, each of which tabs can be flexed substantially independently of other tabs and of said inner zone, whereby inadvertent disruption of the removable central portion in the manufacturing or handling of the container is minimized, said tabs are substantially juxtaposed; in which said central portion is demarked by a pair of concentric, half-cut scores, one of which is cut from the under surface and the other of which is cut from the outer surface; in which said central portion and said inner zone constitute a single imperforate sheet and in which said tabs are integral parts of said sheet; in which a pull tab is attached to said annular rim portion on a press score and in which said half-cut scores curve outwardly to the edges of the pull tab substantially at the ends of said press score, said pull tab being bent back on said score so that it is clamped flat on said cover by said flange; and in which said press score is located essentially at the interface of said outer and inner zones.

10. A container of claim 9, in which said tabs are essentially block-shaped.

11. A container of claim 10, in which said tabs are spaced from adjacent tabs a relatively small proportion of their width.

12. A container of claim 10, in which said tabs are separated by radial cut-lines.

13. A container of claim 3, in which said central portion is demarked by a pair of concentric, half-cut scores, one of which is cut from the under surface and the other of which is cut from the outer surface.

14. A container of claim 9, in which said central portion and said inner zone constitute a single imperforate sheet and in which said tabs are integral parts of said sheet.

15. A container of claim 9, in which a pull tab is attached to said annular rim portion on a press score and in which said half-cut scores curve outwardly to the edges of the pull tab substantially at the ends of said press score, said pull tab being bent back on said score so that it is clamped flat on said cover by said flange.

16. A container of claim 15, in which said press score is located essentially at the interface of said outer and inner zones.

17. A container of claim 15, in which a wire handle projects radially from said container and has a circular portion clamped between said flange and the tabs of said outer, annular zone, and in which said press score is located inwardly of said wire, so that said folded back pull tab, while underlying said flange, does not underly said wire.

18. A container of claim 9, in which a wire handle projects radially from said container and has a circular portion clamped between said flange and the tabs of said outer, annular zone, and in which said press score is located inwardly of said wire, so that said folded back pull tab, while underlying said flange, does not underly said wire.

* * * * *

UNITED STATES PATENT AND TRADEMARK OFFICE

CERTIFICATE OF CORRECTION

PATENT NO. : 4,574,956

DATED : March 11, 1986

INVENTOR(S) : Morris W. Kuchenbecker

It is certified that error appears in the above-identified patent and that said Letters Patent is hereby corrected as shown below:

Col. 5, line 44; "produced" should read -- produces --
Col. 6, line 1; "fixed" should read -- flexed --

Col. 7, line 16; "claim 3" should read -- claim 9 --
(old Cl. 10 is now new Cl. 9)
Col. 8, line 15; "underly" should read -- underlie --
Col. 8, line 22; "underly" should read -- underlie --

Signed and Sealed this

*Twenty-fourth* Day of *June 1986*

[SEAL]

*Attest:*

DONALD J. QUIGG

*Attesting Officer*

*Commissioner of Patents and Trademarks*